United States Patent [19]

Kanamori

[11] Patent Number: 4,518,512

[45] Date of Patent: May 21, 1985

[54] WATER-CONTAINING LUBRICANT

[75] Inventor: Hideo Kanamori, Ichihara, Japan

[73] Assignee: Idemitsu Kosan Company Limited, Tokyo, Japan

[21] Appl. No.: 559,382

[22] Filed: Dec. 8, 1983

[30] Foreign Application Priority Data

Dec. 29, 1982 [JP] Japan ..... 57-229831

[51] Int. Cl.[3] ..... C10M 1/06

[52] U.S. Cl. ..... 252/49.5; 252/38; 252/52 R; 252/52 A

[58] Field of Search ..... 252/49.5

[56] References Cited

U.S. PATENT DOCUMENTS 4,360,443 11/1982 Durr ..... 252/49.5

*Primary Examiner*—William R. Dixon, Jr.
*Assistant Examiner*—Catherine A. Johnson
*Attorney, Agent, or Firm*—Frishauf, Holtz, Goodman & Woodward

[57] ABSTRACT

A water containing lubricant comprising a lubricating base oil, and a water-soluble corrosion inhibitor and water dispersed in the base oil by the use of a mixture of several surfactants having a specific hydrophile lipophile balance (HLB) value, respectively. The lubricant of this invention is a transparent dispersion containing a relatively large amount of water in the base oil, and is useful as an emulsion type metal working oils, hydrolic fluids, gear oils, engine oils, etc.

4 Claims, No Drawings

WATER-CONTAINING LUBRICANT

FIELD OF THE INVENTION

The present invention relates to a water-containing lubricant, and more particularly, to a water-containing lubricant which permits the incorporation of a relatively large amount of water as a transparent dispersion.

BACKGROUND OF THE INVENTION

A transparent water-containing lubricant is known as described in U.S. Pat. No. 3,117,929 and Journal of Colloid and Interface Science, Vol. 42, No. 2 (1973). This lubricant is less flamable than the usual oil type lubricant and thus has received increasing attention in recent years.

Conventional water-containing lubricants, however, have disadvantages in that (1) if the water content decreases owing to evaporation, they change in phase from liquid to solid (the form of phase inversion is unsuitable), (2) therefore, even if water is replenished, the original state cannot be recovered (the phase inversion is irreversible), (3) if the temperature rises, they sometimes change into cloudy emulsions (the phase inversion temperature exists), (4) thereafter, even if the temperature is lowered, the original state sometimes cannot be recovered (the phase inversion temperature exists and then the phase inversion is irreversible), and (5) even though the original state is recovered once, if this cycle is repeated, the original state cannot be recovered. Hence they are not suitable for use as lubricating oils to be used in lubricating parts where the temperature changes cyclically and the amount of water changes invariably.

SUMMARY OF THE INVENTION

An object of the invention is to provide a water-containing lubricant which is free from the above-described problems and can be used in areas where the temperature changes cyclically and the amount of water changes invariably.

It has been found that the object can be attained by using several surfactants having different physical properties in specific proportions.

The present invention relates to a water-containing lubricant comprising a lubricating base oil, and a water-soluble corrosion inhibitor and water which are dispersed in the base oil by the use of a mixture wherein the mixture consists of (1) a nonionic surfactant having a hydrophile lipophile balance (HLB) value of less than 6, (2) a nonionic surfactant having a HLB value of from 6 to less than 11, (3) a nonionic surfactant having a HLB value of from 11 to less than 20, and (4) an ionic surfactant having a HLB value of not less than 15.

DETAILED DESCRIPTION OF THE INVENTION

As the lubricating base oil as used herein, either of mineral oil and synthetic oil can be used. If necessary, the base oil may contain additives such as an oiliness agent, an extreme pressure additive, and an oxidation inhibitor.

The surfactants as used herein will hereinafter be described in detail.

The term "surfactant" as used herein includes, as well as ionic surfactants (anionic, cationic and ampholytic surfactants) and nonionic surfactants, aliphatic alcohols and fatty acids.

In the present invention, four types of surfactants having different HLB values are used in combination. That is, the surfactant mixture as used herein consists of (1) a nonionic surfactant having a HLB value of less than 6, (2) a nonionic surfactant having a HLB value of from 6 to less than 11, (3) a nonionic surfactant having a HLB value of from 11 to less than 20, and (4) an ionic surfactant having a HLB value of not less than 15.

(1) Surfactant having a HLB value of less than 6

Nonionic surfactants, aliphatic alcohols, and fatty acids are preferred. These nonionic surfactants are preferably esters of fatty acids and polyhydric alcohols, and polyoxyalkylene type compounds. Aliphatic alcohols and fatty acids preferably contain from 7 to 30 carbon atoms. Typical examples include propylene glycol monolaurate, propylene glycol monostearate, stearic acid monoglyceride, oleic acid monoglyceride, sorbitan monostearate, sorbitan distearate, sorbitan tristearate, sorbitan monooleate, sorbitan sesquioleate, sorbitan dioleate, sorbitan trioleate, polyoxyethylene nonylphenyl ether, oleyl alcohol, stearyl alcohol, oleic acid, and stearic acid.

(2) Surfactant having a HLB value of from 6 to less than 11

Nonionic surfactants are preferred to use. For example, the above-described esters of fatty acid and polyhydric alcohol and polyoxyalkylene type compounds such as polyoxyethylene or polyethylene glycol ethers or esters are preferably used. Typical examples include sorbitan monolaurate, sorbitan monopalmitate, polyoxyethylene lauryl ether, polyoxyethylene stearyl ether, polyoxyethylene oleyl ether, polyoxyethylene nonylphenyl ether, polyoxyethylene sorbitan monostearate, polyoxyethylene sorbitan monooleate, and polyethylene glycol monooleate.

(3) Surfactant having a HLB value of from 11 to less than 20

As in the case of the surfactant (2) above, nonionic surfactants are preferred. For example, the above-described polyoxyethylene or polyethylene glycol ethers or esters are used.

(4) Surfactant having a HLB value of not less than 15

Ionic surfactants are preferred. Examples are metal salts of fatty acids containing from 7 to 18 carbon atoms, metal salts of naphthenic acid, esters of alkyl sulfates, and alkyl sulfonates.

The HLB value is determined herein by a Griffin method in the case of nonionic surfactants, while by a Davies method in the case of ionic surfactants, aliphatic alcohols, and fatty acids. (cf. Handbook of Surace Active Agents, Sangyo Tosho Publishing Co., Ltd. Japan, p. 307–327 (Dec. 20, 1966))

As the water-soluble corrosion inhibitor, known compounds such as nitrogen-containing organic corrosion inhibitor and inorganic corrosion inhibitor can be used. Typical examples include alkylamines and alkanolamines such as tri-n-butylamine, cyclohexylamine, mono-, di- or triethanolamine, mono-, di- or tripropanolamine, n-butyldiethanolamine, diethyldiethanolamine, N-methyldiethanolamine, and N-dibutyldiethanolamine, salts of carboxylic acids such as fatty acids containing from 6 to 20 carbon atoms, aromatic carboxylic acids and dibasic acids containing from 2 to 20 carbon atoms with the above-described alkylamines or alkanolamines or with ammonium, condensates of the above-described carboxylic acids and amines, and inorganic salts such as sodium nitrite, cobalt nitrite and sodium carbonate.

A predetermined amount of water is further compounded in the lubricant of the present invention.

The amount of each component being added (per 100 parts by weight of the base oil) is as follows:

Water: from 1 to 1,000 parts by weight and preferably from 5 to 500 parts by weight;

Water-soluble anti-corrosion agent: from 0.1 to 20 parts by weight and preferably from 0.5 to 10 parts by weight;

Surfactant (1): from 2 to 80 parts by weight and preferably from 3 to 50 parts by weight;

Surfactant (2): from 2 to 80 parts by weight and preferably from 3 to 50 parts by weight;

Surfactant (3): from 2 to 80 parts by weight and preferably from 3 to 50 parts by weight; and Surfactant (4): from 0.5 to 80 parts by weight and preferably from 2 to 50 parts by weight.

The water-containing lubricant of the invention may contain antifreeze such as ethylene glycol, if necessary. Addition of such poor point depressant lowers the pour point of the water-containing lubricant, i.e., the temperature limit at which the water-containing lubricant is usable. The amount of the pour point depressant added is from 5 to 100 parts by weight, preferably from 20 to 50 parts by weight per 100 parts by weight of the water.

The action of surfactant plays a significant factor in lubricants containing a large amount of water, and it is considered that surfactant molecules form micelles in the interface and constitute a protective colloid layer. The present invention uses a combination of nonionic and ionic surfactants having specific HLB values, and this combination permits the formation of a transparent dispersion containing a relatively large amount of water in the base oil. The water-containing lubricant of the invention offers various advantages. Some of the advantages are given below.

(1) The water-containing lubricant remains in the form of liquid even if its water content decreases owing to evaporation.

(2) When the water content decreases, the original state can be completely removed by replenishing water.

(3) The phase inversion temperature can be controlled to at least 70° C. and furthermore the phase inversion is reversible. Thus the original state can be recovered when the temperature is lowered.

(4) The water-containing lubricant is stable and keeps its transparent state even if its temperature is raised and lowered cyclically.

Hence the water-containing lubricant of the invention is very useful as, for example, an emulsion type metal working oils, hydraulic fluids, gear oils and engine oils.

The present invention is described in greater detail with reference to the following Examples and Comparative Examples.

EXAMPLES 1 TO 12, AND COMPARATIVE EXAMPLES 1 TO 8

Water-containing lubricants were prepared by compounding a lubricating base oil, surfactants, water, a water-soluble corrosion inhibitor, and various additives in the amounts (weight parts) shown in Table 1.

The properties of the thus-prepared lubricants were measured, and the results are shown in Table 2.

TABLE 1

| | Example | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Lubricating Base Oil | | | | | | | | | | | | |
| Mineral Oil A*1 | 70 | 79.5 | 79.5 | — | — | — | 99.5 | 99.5 | 99.5 | 99.5 | 93.5 | 98.5 |
| Mineral Oil B*2 | — | — | — | 99.5 | 98.5 | 98.5 | — | — | — | — | — | — |
| Additive | 15*3 | 20*5 | 20*5 | — | — | — | — | — | — | — | 4.3*7 | — |
| Additive | 15*4 | 0.5*6 | 0.5*6 | 0.5*6 | 1.5*6 | 1.5*6 | 0.5*6 | 0.5*6 | 0.5*6 | 0.5*6 | 2.2*6 | 1.5*6 |
| Surfactant | | | | | | | | | | | | |
| (1)*8 | 8 | 8 | — | 30 | 20 | — | 40 | 40 | 40 | 20 | 43.5 | 10 |
| (1)*9 | — | — | 8 | — | — | — | — | — | — | — | — | — |
| (1)*10 | — | — | — | — | — | 15 | — | — | — | — | — | — |
| (2)*11 | 8 | 8 | 8 | 30 | 20 | 7 | — | — | 40 | 20 | 43.5 | — |
| (2)*12 | — | — | — | — | — | — | 40 | 40 | — | — | — | — |
| (2)*13 | — | — | — | — | — | — | — | — | — | — | — | 7 |
| (3)*14 | 8 | 8 | 8 | 30 | 20 | 7 | 40 | — | — | — | 43.5 | — |
| (3)*15 | — | — | — | — | — | — | — | 40 | 40 | — | — | — |
| (3)*16 | — | — | — | — | — | — | — | — | — | 20 | — | 30 |
| (4)*17 | 8 | 3 | 3 | 15 | — | 5 | 1 | 1 | 1 | 1 | 21.8 | 5 |
| (4)*18 | — | — | — | 8 | 10 | — | — | — | — | — | — | — |
| (4)*19 | — | — | — | 8 | 10 | — | — | — | — | — | — | — |
| Corrosion Inhibitor | | | | | | | | | | | | |
| A*20 | 1.5 | — | — | — | — | 1 | — | — | — | — | — | 1 |
| B*21 | — | 2.5 | 2.5 | 6 | 3 | 1 | 1 | 1 | 1 | 1 | 1 | 1 |
| C*22 | — | 2.5 | 2.5 | — | 3 | — | — | — | — | — | — | — |
| Water | | | | | | | | | | | | |
| Water | 25 | 30 | 30 | 130 | 130 | 25 | 130 | 130 | 130 | 130 | 174 | 25 |
| Pour Point Depressant*23 | 8 | — | — | — | — | 8 | — | — | — | — | — | — |

| | Comparative Example | | | | | | | |
|---|---|---|---|---|---|---|---|---|
| | 1 | 2 | 3 | 4 | 5 | 6 | 7 | 8 |
| Lubricating Base Oil | | | | | | | | |
| Mineral Oil A*1 | — | — | — | — | — | 70 | 98.5 | 98.5 |
| Mineral Oil B*2 | 98.5 | 98.5 | 98.5 | 98.5 | 98.5 | — | — | — |
| Additive | — | — | — | — | — | 15*3 | — | — |
| Additive | 1.5*6 | 1.5*6 | 1.5*6 | 1.5*6 | 1.5*6 | 15*4 | 1.5*6 | 1.5*6 |
| Surfactant | | | | | | | | |
| (1)*8 | 30 | 30 | — | 30 | 30 | 8 | 8 | — |
| (1)*9 | — | — | — | — | — | — | 1.5 | — |

TABLE 1-continued

| | | | | | | | | |
|---|---|---|---|---|---|---|---|---|
| (1)*10 | — | — | — | — | — | — | 16 | — |
| (2)*11 | 30 | — | 30 | 30 | 30 | 8 | 4 | 100 |
| (2)*12 | — | — | — | — | — | — | — | — |
| (2)*13 | — | — | — | — | — | — | — | — |
| (3)*14 | — | 30 | 30 | 30 | 30 | 8 | — | — |
| (3)*15 | — | — | — | — | — | — | — | — |
| (3)*16 | — | — | — | — | — | — | — | — |
| (4)*17 | 15 | 15 | 15 | — | 15 | 8 | — | 25*24 |
| (4)*18 | 8 | 8 | 8 | — | 8 | — | — | — |
| (4)*19 | 8 | 8 | 8 | — | 8 | — | — | — |
| Corrosion Inhibitor | | | | | | | | |
| A*20 | — | — | — | — | — | — | 5 | — |
| B*21 | 6 | 6 | 6 | 6 | — | — | — | — |
| C*22 | — | — | — | — | — | — | 4 | — |
| Water | | | | | | | | |
| Water | 130 | 130 | 130 | 130 | 130 | 25 | 25 | 350 |
| Pour Point Depressant*23 | — | — | — | — | — | 8 | — | — |

Note:
*1: Paraffinic mineral oil (60 spindle oil, produced by Idemitsu Kosan Co., Ltd.: 8 centistokes at 40° C.)
*2: Paraffinic mineral oil (100 neutral oil, produced by Idemitsu Kosan Co., Ltd.: 20 centistokes at 40° C.)
*3: Nonyl polysulfide (trade name: Nonyl polysulfide, produced by Nippon Thiochemical Co., Ltd.)
*4: Chlorinated paraffin (trade name: Enpara L-45, produced by Ajinomoto Co., Ltd.)
*5: Octyl palmitate (trade name: Unister MB-816, produced by Nippon Oils & Fats Co., Ltd.)
*6: 2,6-Di-tert-butyl-p-cresol (trade name: Sumilizer BHT, produced by Sumitomo Chemical Co., Ltd.)
*7: Zinc dithiophosphate (trade name: OLOA-267, produced by Karonite Chemical Co., Ltd.)
*8: Oleyl alcohol (trade name: Oleyl Alcohol, produced by Kyowa Oils and Fats Co., Ltd.; HLB: 1)
*9: Oleic acid (trade name: NAA34, produced by Nippon Oils & Fats Co., Ltd.; HLB: 1)
*10: Sorbitan monooleate (trade name: NIKKOL-SO-10T, produced by Nippon Surfactant Industries Co., Ltd.; HLB: 4.3)
*11: Polyoxyethylene nonylphenyl ether (n = 6) (HLB: 8.6)
*12: Polyoxyethylene oleyl ether (n = 5) (HLB: 10.0)
*13: Polyethylene glycol monooleate (200) (HLB: 8.3)
*14: Polyoxyethylene nonylphenyl ether (n = 9) (HLB: 12.4)
*15: Polyoxyethylene oleyl ether (n = 20) (HLB: 15.0)
*16: Polyethylene glycol monooleate (600) (HLB: 13.6)
*17: Petroleum sulfonate (trade name: Sulfol 430, produced by Matsumura Oil Research Corp.: HLB: 30)
*18: Sodium dodecylbenzenesulfonate (trade name: Neopelex, produced by Kao Soap Co., Ltd: HLB: 37)
*19: Sodium alkylnaphthalenesulfonate (trade name: Pelex NB-L, produced by Kao Soap Co., Ltd.; HLB: 35.5)
*20: Diethanolamine salt of capric acid
*21: N—Methyldiethanolamine
*22: N—Dibutyldiethanolamine
*23: Diethylene glycol
*24: Sodium caprate

TABLE 2

| | Example | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Appearance*1 | Transparent and homogeneous | | | | | | | | | | | |
| Temperature of Phase Inversion into Emulsion*2 | >100° C. | >100° C. | >100° C. | >100° C. | >100° C. | >100° C. | 70° C. | 80° C. | 75° C. | 70° C. | 90° C. | >100° C. |
| State during Evaporation of Water*3 | Liquid | Liquid | Liquid | Liquid | Liquid | Liquid | Liquid | Liquid | Liquid | Liquid | Liquid | Liquid |
| Reversibility of Phase Inversion*4 (Temperature) | Reversible | Reversible | Reversible | Reversible | Reversible | Reversible | Reversible | Reversible | Reversible | Reversible | Reversible | Reversible |
| Storage Stability*5 (Six Months) | | | | | | | | | | | | |
| Appearance of Test Piece | | | | No change | | | | | | | | |
| Appearance of Liquid | | | | No change | | | | | | | | |
| Reversibility of Phase Inversion (Aqueous Dispersion)*4 | Reversible | Reversible | Reversible | Reversible | Reversible | Reversible | Reversible | Reversible | Reversible | Reversible | Reversible | Reversible |
| Stability during Circulation*6 | Good | Good | Good | Good | Good | Good | Good | Good | Good | Good | Good | Good |

| | Comparative Example | | | | | | | |
|---|---|---|---|---|---|---|---|---|
| | 1 | 2 | 3 | 4 | 5 | 6 | 7 | 8 |
| Apperance*1 | Cloudy | Cloudy | Cloudy | Transparent and homogeneous | | | | |
| Temperature of Phase Inversion into Emulsion*2 | — | — | — | 35° C. | >100° C. | >100° C. | 80° C. | 90° C. |
| State during Evaporation | — | — | — | Liquid | Liquid | Liquid | Solidified | Solidified |

TABLE 2-continued

| | | | | | | | | |
|---|---|---|---|---|---|---|---|---|
| of Water*3 | | | | | | | | |
| Reversibility of Phase Inversion*4 (Temperature) | — | — | — | Reversible | Reversible | Reversible | Irreversible | Irreversible |
| Storage Stability*5 (Six Months) Appearance of Test Piece | — | — | — | No change | Formation of Rust | Corrosion of Whole Surface | No change | Formation of Rust |
| Appearance of Liquid | — | — | — | No change | Cloudy | Cloudy | No change | Cloudy |
| Reversibility of Phase Inversion (Aqueous Dispersion)*4 | — | — | — | Reversible | Reversible | Reversible | Irreversible | Irreversible |
| Stability during Circulation*6 | — | — | — | Bad | Bad | Bad | Bad | Bad |

Note:

*1: Appearance A water-containing lubricant is placed in a glass bottle immediately after the production thereof and observed at 20° C. under atmospheric pressure. It becomes transparent and homogeneous if all the ingredients are dissolved.

*2: Temperature of phase inversion into emulsion A water-containing lubricant is raised in temperature from ordinary temperature to 100° C. over about 5 minutes with stirring. During this period, the state of the lubricant is observed. A temperature at which the lubricant becomes cloudy and emulsion-like is referred to as a phase inversion temperature. A 200-milliliters content-beaker is used, and the amount of the lubricant used for this testing is 100 milliliters. Higher phase inversion temperatures are preferred.

*3: State during evaporation of water A water-containing lubricant is stirred while heating at 90–100° C. After 30 minutes, the state of the lubricant is observed. The stirring is performed at 200 revolutions per minute (rpm). The rating is "liquid" or "solidified". A container used is a 200 milliliters content-beaker, and the amount of the lubricant used for this testing is 100 milliliters.

*4: Reversibility of phase inversion This is determined by observing if or not the water-containing lubricant which has been subjected to the phase inversion in (*2) or (*3) above returns to the original state. (a) After the test of (*3) above, an equal amount of water to that lost by evaporation is added to the water-containing lubricant, and the resulting mixture is observed to see if it recovers the original state just after the production thereof when stirred at 200 revolutions per minute (rpm). If it returns to the original state, it is rated as "reversible", whereas if it does not, it is rated as "irreversible". The stirring is performed at 20° C. under atmospheric pressure for 10 minutes. (b) After the test of (*2) above, the water-containing lubricant heated to 100° C. is allowed to cool while stirring at 200 rpm. In a case in which the phase inversion temperature has been measured by the procedure of (*2), if the lubricant returns to the original state prior to the phase inversion in the vicinity of the phase inversion temperature ±10 degrees Centigrade) and has the same appearance as in (*1) at 20° C., it is rated as "reversible", whereas if it does not, it is rated as "irreversible". Also, in a case in which the phase inversion temperature has not been measured by the procedure of (*2), the lubricant is allowed to cool and, during this cooling time, it is observed. If the phase inversion does not occur during this cooling procedure and the appearance of the lubricant when cooled to 20° C. is the same as in (*1), it is rated as "reversible", whereas if it does not, it is rated as "irreversible".

*5: Storage stability (a) Appearance of test piece A water-containing lubricant (150 milliliters) is placed in a 200 milliliters content-glass bottle (inner diameter: 25 millimeters; height: 150 millimeters) with a cap. In this bottle, a test piece of SPCC (cold rolled steel plate) of thickness 1 millimeter, width 20 millimeters and length 120 millimeters was placed. The bottle is covered with the cap and is allowed to stand for 6 months while maintaining at a temperature of 20° C. At the end of the time, the surface of the plate is examined. If no rust is formed, it is rated as "no change", whereas if rust is formed, it is rated as "formation of rust". (b) Appearance of liquid After the test by the procedure of (*5), the state of the lubricant is observed and determined if it is transparent and homogeneous or not.

*6: Stability during circulation A water-containing lubricant is subjected to a circulation test for one month by the use of a gear pump. Thereafter, it is tested for from (*1) to (*4) above. If the lubricant produces the same results as just after the production thereof, it is rated "good", whereas if it does not, it is rated as "bad". In this testing, a 20-liter tank is used and its temperature is set at 50° C. The flow rate of the pump is 4 liters per minute. In order to maintain the water content at a predetermined level, water is replenished by means of an automatic water feeding machine.

What is claimed is:

1. A water-containing lubricant comprising per 100 parts by weight of a lubricating base oil, from 0.1 to 20 parts by weight of a water-soluble corrosion inhibitor and from 1 to 1,000 parts by weight of water dispersed in the base oil by the use of a surfactant mixture, said surfactant mixture consisting essentially of (1) from 2 to 80 parts by weight of a nonionic surfactant selected from the group consisting of an ester of fatty acid and polyhydric alcohol, or polyoxyalkylene type compound, aliphatic alcohol having from 7 to 30 carbon atoms and fatty acid having from 7 to 30 carbon atoms, having a hydrophile lipophile balance (HLB) value of less than 6, (2) from 2 to 80 parts by weight of a nonionic surfactant which is an ester of fatty acid and polyhydric alcohol, or a polyoxyalkylene type compound, having a HLB value of from 6 to less than 11, (3) from 2 to 80 parts by weight of a nonionic surfactant which is an ester of fatty acid and polyhydric alcohol, or polyoxyalkylene type compound, having a HLB value of from 11 to less than 20, and (4) from 0.5 to 80 parts by weight of an ionic surfactant selected from the group consisting of metal salts of fatty acid having from 7 to 18 carbon atoms, metal salts of naphthenic acid, esters of alkyl sulfates and alkyl sulfonates, having a HLB value of not less than 15.

2. The water-containing lubricant as claimed in claim 1 wherein said water-soluble corrosion inhibitor is in an amount from 0.5 to 10 parts by weight; said water is in an amount from 5 to 500 parts; wherein each of said surfactants (1), (2), and (3) is in an amount from 3 to 50 parts; and wherein said surfactant (4) is in an amount from 2 to 50 parts.

3. The water-containing lubricant as claimed in claim 1 wherein said corrosion inhibitor is selected from the group consisting of alkylamines and alkanolamines.

4. The water-containing lubricant as claimed in claim 2 wherein said corrosion inhibitor is selected from the group consisting of alkylamines and alkanolamines.

* * * * *